US009561392B2

(12) United States Patent
Bodizs et al.

(10) Patent No.: US 9,561,392 B2
(45) Date of Patent: Feb. 7, 2017

(54) METHOD FOR DILUTING AND/OR EJECTING CLOUDS OF FLAMMABLE GASES

(71) Applicant: BASF SE, Ludwigshafen (DE)

(72) Inventors: Levente Csaba Bodizs, Marl (DE); Franz Niklaus Windlin, Heidelberg (DE); Klaus Peter Gumbel, Mannheim (DE); Johannes Fischer, Ludwigshafen (DE); Oliver Odenwald, Dielheim (DE); Jens Denecke, Speyer (DE)

(73) Assignee: BASF SE, Ludwigshafen (DE)

( * ) Notice: Subject to any disclaimer, the term of this patent is extended or adjusted under 35 U.S.C. 154(b) by 3 days.

(21) Appl. No.: 14/410,970

(22) PCT Filed: Jun. 25, 2013

(86) PCT No.: PCT/EP2013/063217

§ 371 (c)(1),
(2) Date: Dec. 23, 2014

(87) PCT Pub. No.: WO2014/005881

PCT Pub. Date: Jan. 9, 2014

(65) Prior Publication Data

US 2015/0165250 A1 Jun. 18, 2015

(30) Foreign Application Priority Data

Jul. 2, 2012 (EP) ..... 12174577

(51) Int. Cl.
*A62C 2/04* (2006.01)
*A62C 3/06* (2006.01)
(Continued)

(52) U.S. Cl.
CPC . *A62C 2/04* (2013.01); *A62C 2/08* (2013.01); *A62C 3/06* (2013.01); *A62C 3/14* (2013.01); *A62C 99/0018* (2013.01)

(58) Field of Classification Search
CPC ..... A62C 2/04; A62C 3/06; A62C 99/0018
See application file for complete search history.

(56) References Cited

U.S. PATENT DOCUMENTS 2,120,563 A 6/1938 Lamb
4,187,913 A * 2/1980 Wilcox ..... A62C 33/04 169/51

(Continued)

FOREIGN PATENT DOCUMENTS

CA 2 174 677 10/1997
DE 39 08 823 12/1989

OTHER PUBLICATIONS

International Search Report issued Jul. 8, 2014, in PCT/EP13/063217 filed Jun. 25, 2013.

(Continued)

*Primary Examiner* — Ryan Reis
(74) *Attorney, Agent, or Firm* — Oblon, McClelland, Maier & Neustadt, L.L.P.

(57) ABSTRACT

The invention relates to the use of a gas or liquid-jet curtain generated by spraying non-flammable gases or liquids for diluting and/or ejecting clouds of flammable gases, the density of which does not exceed the density of air, from containments that have one or more outer openings, and also to a method for diluting and/or ejecting clouds of flammable gases, the density of which does not exceed the density of air, from containments that have one or more outer openings, wherein, by spraying non-flammable gases or liquids at at least one outer opening, a gas or liquid-jet curtain is generated that dilutes the clouds of flammable gases situated in the containment or bears them in the direction of the at least one outer opening and thus ejects them.

11 Claims, 1 Drawing Sheet

(51) Int. Cl.

| | |
|---|---|
| ***A62C 2/08*** | (2006.01) |
| ***A62C 2/06*** | (2006.01) |
| *A62C 99/00* | (2010.01) |

(56) References Cited

U.S. PATENT DOCUMENTS 4,703,808 A * 11/1987 O'Donnell ..... A62C 31/22 169/91
4,779,801 A * 10/1988 O'Donnell ..... A62C 31/22 169/91
4,986,364 A * 1/1991 Clark ..... A62C 3/00 169/37

OTHER PUBLICATIONS

Seifert, et al., "VDI Berichten [VDI reports] 567, Verfahrenstechnik 1984", 1985, 13 pages.
Lees, Loss Prevention in the Process Industries—Hazard Identification, Assesment and Control, 2nd edition, vol. 1, Chapter 15.53. 18, Emission and Dispersion, 15/325, Sep. 25, 1996, 1 page.
"Guidelines for Postrelease Mitigation Technology in the Chemical Process Industry", Chapter 4.6.2 "Steam Curtains" , 1997, pp. 83-86.

* cited by examiner

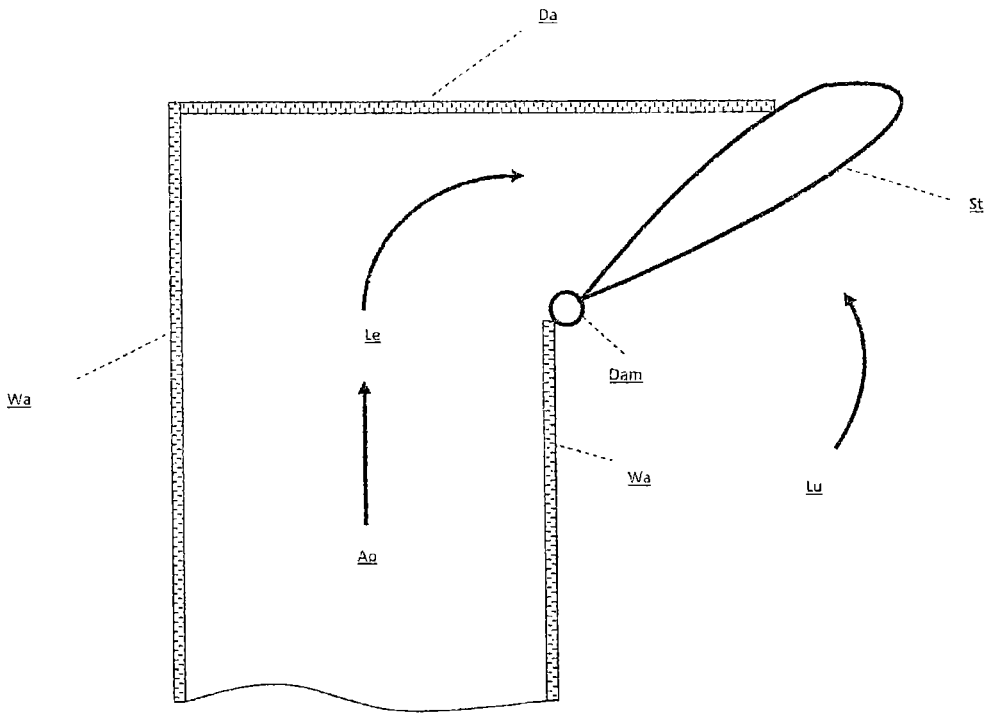
Da
St
Le
Dam
Wa
Wa
Lu
Ao

METHOD FOR DILUTING AND/OR EJECTING CLOUDS OF FLAMMABLE GASES

The invention relates to a method for diluting and/or ejecting clouds of flammable gases, a device suitable therefor, and the use of gas or liquid-jet curtains for this purpose.

Leaks in devices and apparatuses, via which flammable gases can escape, are a considerable safety risk, in particular if ignition sources are situated in the vicinity.

In VDI Berichten [VDI reports] 567, Verfahrenstechnik 1984, pages 391 to 412 (1985), H. Seifert and H. Giesbrecht report on steam curtains as a safety measure against gas escapes close to ground. This explains that mixing of air into heavy gas clouds close to the ground can be markedly enhanced by steam jets exiting vertically at the ground. Such steam curtains can be used as a safety measure against unintended releases of flammable or toxic gases. In a steam curtain, the steam jets exiting with a high momentum from small openings of a tube laid in the ground entrain heavy gas from one side and air from the side facing away from the leak and transport this mixture upwards. Above the heavy gas layer, air is mixed in from both sides. The concentration distribution can then be calculated according to the laws of a flat free jet.

In Loss Prevention in the Process Industries—Hazard Identification, Assessment and Control, F. P. Lees, 2nd edition, Emeritus, volume 1, chapter 15.53.18, steam curtains are described which can be used for diluting flammable gases escaping via leaks, which flammable gases are heavier than air. In this case the plant that is to be protected is surrounded by a solid, but lightly constructed, wall. A horizontal steam conduit having a number of narrow openings is mounted close to the upper edge of the wall. The wall is, for example, 1.5 m high. The steam tube is designed in such a manner that the individual jets together give a flat jet.

In chapter 4.6.2 "Steam Curtains" in the book "Guidelines for Postrelease Mitigation Technology in the Chemical Process Industry", Center for Chemical Process Safety, AIChE, 1997, steam and gas curtains are described on pages 83 to 86. Steam curtains are used for dilution of gases that are heavier than air. In this case the steam curtain should enclose the entire area in which a gas leak can occur. It is again stated that a gas main should be mounted on a low wall, on the upper edge thereof, at a height of about 1.5 m. The wall in this case serves as a gas fence which retards a dispersion of the gas cloud and facilitates the detection of the gas cloud. A device is described in which a 6 inch diameter pipe is used that has 5/32 inch holes at 4 inch intervals. Steam is charged at 250 psig steam for forming the steam curtain. For preventing the development of static electricity, the pipes must be well grounded. Hydrogen pipes can be safeguarded at connection sites by a ring-shaped arrangement of steam jets.

The object of the present invention is providing a method for diluting and/or ejecting clouds of flammable gases, the density of which does not exceed the density of air, from containments that, apart from outlet openings, are preferably closed on all sides.

The object is achieved according to the invention by the use of a gas or liquid-jet curtain generated by spraying non-flammable gases or liquids for diluting and/or ejecting clouds of flammable gases, the density of which does not exceed the density of air, from containments that have one or more outer openings.

The object is additionally achieved by a method for diluting and/or ejecting clouds of flammable gases, the density of which does not exceed the density of air, from containments that have one or more outer openings, in which, by spraying non-flammable gases or liquids at at least one outer opening, a gas or liquid-jet curtain is generated that dilutes the clouds of flammable gases situated in the containment or bears them in the direction of the at least one outer opening and thus ejects or discharges them.

The object is additionally achieved by a corresponding containment. "Containments" are taken to mean, according to the invention, containers, buildings, etc. that comprise devices for producing, storing, processing or transporting chemical substances, out of which, in the event of a leak, flammable gases exit, the density of which does not exceed the density of air on exit. The containments are not completely sealed from the outside, i.e. from the environment or atmosphere, but have one or more outer openings. The containments differ thereby per se, e.g. from reactors or pipes. The outer openings in this case are permanently open to the environment or atmosphere and are also not temporarily closed, as would be the case with doors, windows, valves, etc. The containment is therefore generally at the same pressure level as or a very similar pressure level to the environment, or the atmosphere.

It has been found according to the invention that the dilution and/or ejection of flammable gases of low density succeeds using gas- or liquid-jet curtains. In this case, the flammable gas which typically emerges from a leak in an apparatus is density-neutral or lighter with respect to air under identical ambient conditions (pressure, temperature) and/or under the exit conditions. Therefore, the flammable gas is precisely not a heavy gas as defined in VDI guideline 3786. A heavy gas is, typically, at least 16% heavier than air.

In open plants, it is generally assumed that flammable gases that are lighter than air escape upwards and disperse in an uncontrolled manner.

However, the situation is different if the plant in which a gas leak can occur is present in a containment that has only a few outer openings. In this case, in the event of a leak, the light gas cannot disperse in an uncontrolled manner.

The formation of an explosive gas mixture is prevented according to the invention by spraying non-flammable gases or liquids at at least one outer opening. Thus a gas- or liquid-jet curtain is generated in this manner, which dilutes flammable gases situated in the containment, or bears them in the direction of the at least one outer opening and thus ejects or discharges them.

The expression "at an outer opening" is therefore to be understood functionally in such a manner that the jet curtain is spatially arranged thus at or in the vicinity of the outer opening in such a manner that the clouds of flammable gases are diluted and preferably borne in the direction of the at least one outer opening and thus ejected or discharged from the containment. Frequently, the jet curtain entirely or at least partially covers the at least one outer opening.

In this case the containment frequently comprises devices for production, processing or storage of the flammable gases. Corresponding devices are, for example, reactors, tanks, or pressurized gas cylinders, heat exchangers, columns or entire plants, or conduits.

The flammable gas can be selected from any desired flammable gases the density of which does not exceed the density of air (under identical temperature and identical pressure). Flammable gases used according to the invention therefore, in a corresponding containment, do not fall to the bottom of the containment.

Examples of suitable flammable gases are acetylene, hydrogen, ammonia, carbon monoxide, coke oven gas, landfill gas, town gas, biogas, synthesis gas, methane or natural gas, or hot flammable gases.

The liquid- or gas-jet curtain can be generated by any desired suitable non-flammable gases or liquids. For example, it can be a liquid-jet curtain of water. Preferably, it is a gas-jet curtain which is formed by steam, air, nitrogen or mixtures thereof, preferably by steam. The steam in this case can be present at the pressure stages provided in the plant or plant surroundings. Typically, in chemical plants, pressure stages for steam of about 1.5 bar, 4 bar or 16 bar are present. Preference is given to 2 to 6 bar.

The ejection from the containment preferably proceeds in such a manner that no ignitable mixture of the flammable gas is present outside the containment. This means that the outflowing liquid or gas rate of the non-flammable liquid or the non-flammable gas is controlled in such a manner that an adequate mixture with the flammable gas exiting from a leak and air additionally drawn in is achieved, in such a manner that a gas mixture that is no longer flammable or ignitable results.

The containments which receive the devices for producing, processing or storing the flammable gases have one or more outer openings. Preferably, the area of the outer openings is a maximum of 40%, particularly preferably a maximum of 20%, in particular a maximum of 10%, of the total outer surfaces of the containment situated above the ground. The area of the outer openings can preferably be at least 0.5%, particularly preferably at least 1%, in particular at least 2%, of the total outer surfaces of the containment situated above the ground.

Frequently, the containment is arranged on the ground and has substantially upright outer walls.

In addition, it is sealed at the top by a roof. At least one outer opening is preferably arranged in the roof or in the outer walls immediately bordering on the roof. The expression "immediately" denotes a position that is arranged in the upper quarter, preferably upper fifth, in particular upper tenth, of the outer walls. Particularly preferably, this outer opening is situated directly on the upper edge of the outer walls and therefore directly bordering on the roof. Further outer openings can be provided at other points of the containment, e.g. in order to permit the inflow of external air into the containment.

According to the invention, one or more outer openings can be present in the containments. Preferably, 1 to 5, particularly preferably 1 to 3, in particular 1 or 2 outer openings are present.

The gas- or liquid-jet curtain is formed in such a manner that at least 80%, preferably at least 90%, in particular at least 95%, especially all, of the clouds of flammable gases, during the ejection, pass, or must pass, through the gas- or liquid-jet curtain. This ensures that there is adequate dilution and adequate transport of the flammable gas cloud due to the jet curtain. Depending on the design of the containment or the outer opening or outer openings, a jet curtain can be provided for each outer opening. It is also possible that a jet curtain is not provided for each outer opening and the remaining outer openings serve only for the inflow of air, diluted with the flammable gas, exits again through the jet curtain and through another outer opening.

Typically, the containment will have vertically upright outer walls and a flat or pointed roof which rests upon the outer walls. The outer openings can have any desired outline. They can have, for example, a square or approximately square outline, wherein one edge of the outer opening proceeds horizontally. The gas- or liquid-jet curtain can in this case be, for example, at an angle of, for example, 45°±10° to the roof or to the outer wall. This means that the gas- or liquid-jet curtain need not meet the outer opening perpendicularly or need not be parallel thereto, but can be at an oblique angle thereto. The gas- or liquid-jet curtain can also be arranged, for example, on an inwardly displaced outer wall in such a manner that it is orientated at an angle of about 45° to the roof and can additionally draw in an entrain ambient air from the bottom.

A corresponding embodiment is shown schematically in the accompanying FIG. 1. FIG. 1 shows a cross sectional view of outer wall (Wa) and roof (Da) in the region of the jet curtain (St) which is generated by a steam conduit (Dam) that is provided with boreholes. The outer wall (Wa), at the upper edge of which the jet curtain (St) is formed, is offset inwardly compared with the roof edge, wherein it produces an outer opening. By forming the jet curtain (St) at an angle of about 40° to the horizontal inclined upwards, flammable gas (light gas (Le)) is entrained from the interior of the containment, and escapes from apparatus having a leak (Ap) and air (Lu) is entrained from the outer surroundings of the containment, which air leads to dilution of the flammable gas.

According to the invention, all outer openings can be covered by gas- or liquid-jet curtains in such a manner that the flammable gas must pass in each case through a gas- or liquid-jet curtain. Preferably, at least outer openings close to the roof are covered by corresponding jet curtains.

The gas- or liquid-jet curtain is preferably generated by exit of a gas or a liquid from a tube which, along the longitudinal axis thereof, perpendicularly to the longitudinal axis, has boreholes which can be on the tube surface on a common connection line. For example, a tube having an internal diameter of about 8 cm can be used (DN 80) which has boreholes having a diameter of about 5 mm which are provided at a spacing of about 7 cm. A DN 80 pipe piece about 4 m long can thus have about 57 boreholes of diameter 5 mm. It can be operated at a pressure of 4 bar steam.

The steam curtain can—depending on the size of the outer opening to be covered—have a length in the range from preferably 0.5 to 6 m.

The gas- or liquid-jet curtain is preferably triggered under sensor control when a leak of the flammable gas is detected. A corresponding detection and control unit is known for fans which have been provided to date for removing corresponding flammable gases in an emergency.

The method according to the invention can replace a conventional emergency chamber deaeration by fans.

Preferably, in the method according to the invention, the containments are not completely open at the top, since otherwise the gas can escape freely at the top. Preferably, the containment has only the above-described relatively small openings and thus prevents the free dispersion of the readily flammable gas, and so dilution by the gas- or liquid-jet curtain proceeds.

A corresponding steam jet curtain has been provided in a containment which encloses a tube-bundle reactor comprising acetylene, dissolved in liquid acetone. Thus, escape of a flammable acetylene gas cloud can reliably be prevented.

The invention claimed is:

1. A method for diluting clouds of flammable gases from a containment comprising an outer opening using a gas-jet curtain, the method comprising:

spraying a non-flammable gas or liquid at at least one outer opening of the containment to form a gas-jet curtain at the opening;

diluting the clouds of flammable gases from the containment in the gas-jet curtain; and ejecting the diluted flammable gases from the containment in the flow of the gas jet curtain;

wherein the gas-jet curtain is generated by exit of a gas or a liquid from a tube which, along a longitudinal axis, has, perpendicularly to the longitudinal axis, boreholes that lie on a common connection line on a tube surface, and the flammable gases have a density not exceeding the density of air.

2. The method according to claim 1, wherein the containment comprises devices for production, processing or storage of the flammable gases.

3. The method according to claim 1, wherein the flammable gas is selected from the group consisting of acetylene, hydrogen, ammonia, carbon monoxide, a coke oven gas, a landfill gas, a town gas, a biogas, a synthesis gas, methane, natural gas, and a hot flammable gas.

4. The method according to claim 1, wherein the gas-jet curtain is formed by steam, air, nitrogen or any mixture thereof.

5. The method according to claim 1, wherein said ejecting proceeds in such a manner that no ignitable mixture of the flammable gases is present outside the containment.

6. The method according to claim 1, wherein at least 80% of the clouds of flammable gases, during said ejecting, pass through the gas-jet curtain.

7. The method according to claim 1, wherein the containment is arranged on the ground, has substantially upright outer walls and is closed at the top by a roof, and the outer opening is arranged in the roof or in the outer walls immediately bordering the roof.

8. The method according to claim 7, wherein the gas-jet curtain is at an angle of 45°±10° to the roof or outer wall.

9. The method according to claim 1, wherein the outer opening has an area of a maximum of 40% of a total outer area of the containment.

10. The method according to claim 1, wherein the gas-jet curtain has a length of from 0.5 to 6 m.

11. The method according to claim 1, wherein the outer opening has a horizontal lower edge, and the tube extends in parallel to the horizontal lower edge.

* * * * *